US005820699A

United States Patent [19]

Asahi et al.

[11] Patent Number: 5,820,699

[45] Date of Patent: Oct. 13, 1998

[54] MARTENSITIC STAINLESS STEEL HAVING EXCELLENT HOT WORKABILITY AND SULFIDE STRESS CRACKING RESISTANCE

[75] Inventors: Hitoshi Asahi; Takuya Hara, both of Futtsu; Akira Kawakami, Kitakyushu, all of Japan

[73] Assignee: Nippon Steel Corp., Tokyo, Japan

[21] Appl. No.: 776,125

[22] PCT Filed: Jul. 21, 1995

[86] PCT No.: PCT/JP95/01453

§ 371 Date: Apr. 17, 1997

§ 102(e) Date: Apr. 17, 1997

[87] PCT Pub. No.: WO96/03532

PCT Pub. Date: Feb. 8, 1996

[30] Foreign Application Priority Data

Jul. 21, 1994 [JP] Japan ..... 6-169467
Nov. 21, 1994 [JP] Japan ..... 6-286913

[51] Int. Cl.[6] ..... C22C 38/42; C22C 38/44

[52] U.S. Cl. ..... 148/325; 420/61

[58] Field of Search ..... 420/61; 148/32 S

[56] References Cited

U.S. PATENT DOCUMENTS 5,716,465 2/1998 Hara et al. ..... 148/325

FOREIGN PATENT DOCUMENTS 4827569 8/1973 Japan ..... 420/61

OTHER PUBLICATIONS

Key To Steel, 10 Edition 1974, Germany.

*Primary Examiner*—Deborah Yee
*Attorney, Agent, or Firm*—Birch, Stewart, Kolasch & Birch, LLP

[57] ABSTRACT

A martensitic stainless steel capable of developing a tempered martensitic structure, comprising by weight C: 0.005 to 0.05%, Si≦0.50%, Mn: 0.1 to 1.0%, P≦0.03%, S≦0.005%, Mo: 1.0 to 3.0%, Cu: 1.0 to 4.0%, Ni: 5 to 8%, Al≦0.06%, Cr and Mo satisfying a requirement represented by the formula Cr+1.6Mo≧13; and C, N, Ni, Cu, Cr, and Mo satisfying a requirement represented by the formula Ni(eq): 40C+34N+Ni+0.3Cu−1.1Cr−1.8Mo≧−10.5, and optionally at least one member selected from the group consisting of Ti, Zr, Ca, and REM, with the balance consisting essentially of Fe. The present invention provides a martensitic stainless steel having excellent resistance to corrosion by $CO_2$ and sulfide stress cracking and good hot workability.

4 Claims, 3 Drawing Sheets

MARTENSITIC STAINLESS STEEL HAVING EXCELLENT HOT WORKABILITY AND SULFIDE STRESS CRACKING RESISTANCE

TECHNICAL FIELD

The present invention relates to a martensitic stainless steel having excellent resistance to corrosion by $CO_2$ and sulfide stress cracking and good hot workability.

BACKGROUND ART

In recent years, the development of gas wells for producing gases containing a large amount of $CO_2$, as well as $Co_2$ injection has become made extensively. Due to severe corrosion, 13% Cr martensitic stainless steels exemplified by AISI420 having excellent resistance to corrosion by $CO_2$ have been used in such environments. Even these corrosion-resistant steels suffer severe corrosion when the service temperature is increased and exceeds 120° C.

The above environments, in some cases, contain $H_2S$. The above-mentioned corrosion-resistant steels have Japanese Patent Laid-Open Pub. Nos. 054063/1987 and 243740/1990 propose steels which could reduce these problems. These steels, however, cannot satisfactorily withstand a corrosive environment at temperatures above 150° C. For this reason, the development of steels serviceable at higher temperatures has been desired in the art.

Martensitic stainless steels having improved corrosion resistance and corrosion fatigue strength in the corrosive environment of a suction roll for paper-manufacturing, a sea water pump, are described in Japanese Patent Laid-Open Pub. No. 19445/1990. These steels are intended for use in the manufacture by centrifugal casting, and do not have hot workability which is required for the manufacture of a seamless pipe for gas.

Steels having improved sulfide cracking resistance and corrosion resistance are described in Japanese Patent Publication No. 15977/1984 and Japanese Patent Laid-Open Pub. No. 174859/1985 and the like. For these martensitic stainless steels, in order to improve the corrosion resistance, the amounts of C and N added are markedly lowered, or several percent Mo is added with the C content being lowered. This poses a problem that a δ ferrite phase which deteriorates the hot workability is formed in an austenitic matrix upon heating of an ingot of the steel. Therefore, under severe working conditions such as used in seamless rolling, cracks or flaws occur, which unavoidably lowers the yield, increasing the cost. This makes it very difficult to manufacture a seamless pipe having high corrosion resistance using the above constituent system.

The present inventors previously developed a martensitic stainless steel having excellent resistance to corrosion by $CO_2$ and, at the same time, sulfide stress cracking resistance and hot workability and already filed a patent application (Japanese Patent Laid-Open No. 263138/1993). In this steel, the contemplated properties, i.e. resistance to corrosion by $CO_2$, sulfide stress cracking resistance, and hot workability, were realized by the following techniques. (1) The resistance to corrosion by $CO_2$ was realized by reducing the C content and adding a necessary amount of Cr. (2) The sulfide stress cracking resistance was realized by regulating the structure. (3) The hot workability was realized by reducing the contents of P, S and the like to limit the form of inclusions and, at the same time, regulating the amounts of C and N added and further adding Ni to regulate the phase fraction and form of dissimilar phases having different deformation resistance.

Thereafter, the present inventors have made many studies and, as a result, have succeeded in improving the techniques described in Japanese Patent Laid-Open No. 263138/1993 to further improve the sulfide stress cracking resistance and the hot workability necessary for the manufacture of oil-well pipes as a major application for steels.

An object of the present invention is to provide, through the regulation of particular constituents, a martensitic stainless steel which can resist corrosion by $CO_2$ at high temperatures above 150° C. and has excellent sulfide stress cracking resistance and particularly excellent hot workability.

DISCLOSURE OF INVENTION

The martensitic stainless steel having excellent corrosion resistance according to the present invention can develop a martensitic structure and comprises by weight C: 0.005 to 0.05%, Si≦0.50%, Mn: 0.1 to 1.0%, P≦0.03%, S≦0.005%, Mo: 1.0 to 3.0%, Cu: 1.0 to 4.0%, Ni: 5 to 8%, and Al≦0.06%, Cr and Mo satisfying a requirement represented by the formula Cr+1.6Mo≧13; and C, N, Ni, Cu, Cr, and Mo satisfying a requirement represented by the formula Ni(eq): 40C+34N+Ni+0.3Cu−1.8Mo≧−10.5, and optionally at least one member selected from Ti: 0.005 to 0.1%, Zr: 0.01 to 0.2%, Ca: 0.001 to 0.02%, and REM: 0.003 to 0.4%, with the balance consisting essentially of Fe.

BEST MODE FOR CARRYING OUT THE INVENTION

From the results of many experiments conducted by the present inventors, the present inventors have found that (1) the resistance to corrosion by $CO_2$ can be significantly improved by the addition of Cu and Ni in combination, (2) the sulfide stress cracking resistance can be improved by adding Mo, and (3) the hot workability can be maintained by reducing the S content and, at the same time, bringing the structure of the steel to a single phase of austenitic at heating temperature for rolling.

The present invention has been made based on these findings.

The present invention will now be described in more detail.

Figure 1:
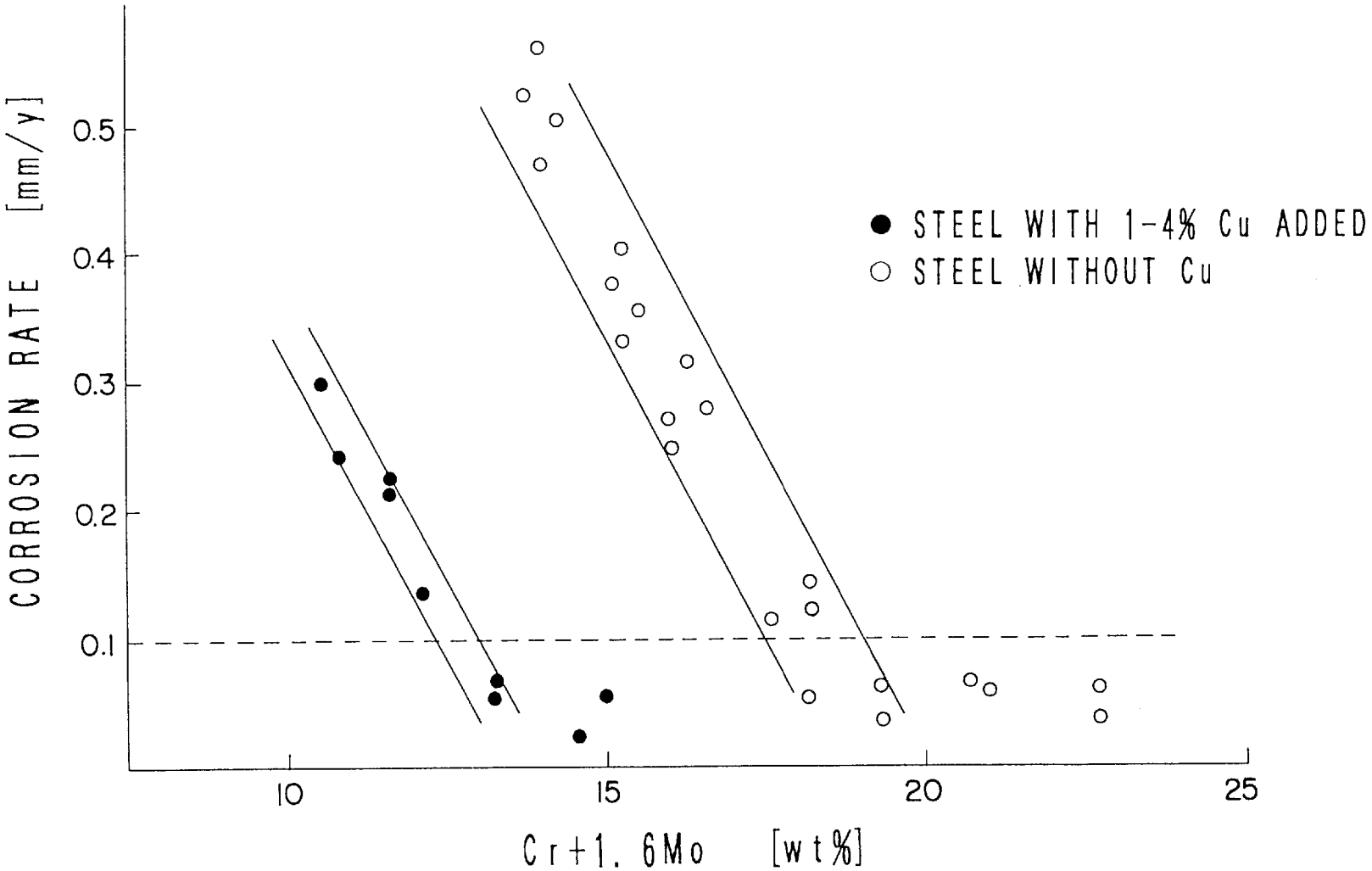
FIG. 1 is a diagram showing the effect of alloying elements on the rate of corrosion by $CO_2$.

FIG. 1 is a diagram showing the corrosion rate of 0.02% C-6% Ni steels with varied Cr, Mo, and Cu contents. In FIG. 1, ● represents data for steels having a Ni content of 6% and a Cu content of 1 to 4%, and ○ represents data for steels having a Ni content of 6% with no Cu added. The corrosion rate (CR) is expressed as the depth of corrosion per year in artificial sea water of 180° C. equilibrated with $CO_2$ gas of 40 atm. When CR is less than 0.1 mm/y, the steel is evaluated as having satisfactory corrosion resistance.

As can be seen from FIG. 1, the contribution of Mo to the corrosion rate (CR) is 1.6 times greater than the contribution of Cr to the corrosion rate (CR). The CR of the steel with Cu added is the same as that of the steel wherein the content of Cr+1.6Mo is 6% higher than the steel with Cu added. It is noted that Cr and Mo are typical ferrite forming elements and the incorporation of these elements in a large amount results in the formation of a ferrite phase. In order for the steel without Cu (○) to have CR corresponding to Cr+1.6Mo=13% in the case of the steel with Cu added (●), Cr+1.6Mo=19% is necessary. The content of Cr and Mo on this level does not provide a martensitic structure.

On the other hand, in the case of a steel containing Cr+1.6Mo=13% and more than 1% of Cu, the addition of an austenite forming element can bring the structure to a martensitic structure, and Cu per se is an austenite forming element, which is advantageous also from the viewpoint of phase stability. Thus, it has been found that, for the martensitic stainless steel which tends to have high strength, if no Cu is added, it is impossible to attain CR<0.1 mm/y at 180° C.

Figure 2:
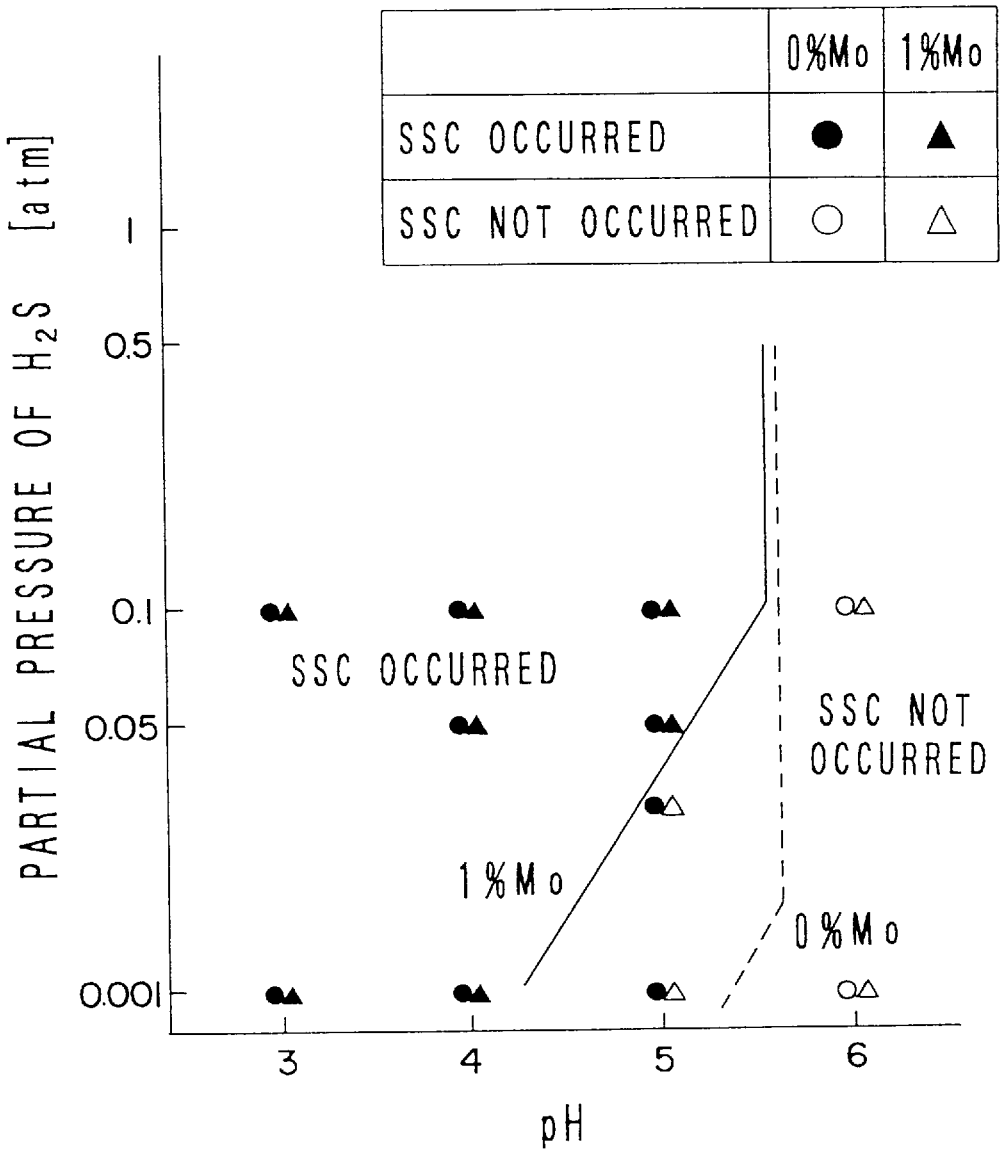
FIG. 2 is a diagram showing the effect of Mo on the sulfide stress cracking resistance.

Then, the influence of Mo addition in environmental conditions (partial pressure of $H_2S$ and pH) where sulfide stress cracking (SSC) could occur was examined, and the results are given in FIG. 2.

In FIG. 2, both ○ and ● represent steels with Mo: 0%, and both Δ and ▲ represent steels with Mo: 1%. For the steels represented by ○ and Δ, SSC did not occur, whereas for the steels represented by ● and ▲, SSC occurred. Two samples, one of which is 0% Mo and the other 1% Mo, were tested under the same conditions with partial pressure of $H_2S$ and pH varied.

In FIG. 2, a dotted line represents the boundary between the occurrence of SSC and the freedom from SSC with respect to 0% Mo, and a solid line represents the boundary between the occurrence of SSC and the freedom from SSC with respect to 1% Mo. From FIG. 2, it is apparent that steels with Mo added are free from SSC even under severe conditions of high partial pressure of $H_2S$ and low pH.

Figure 3:
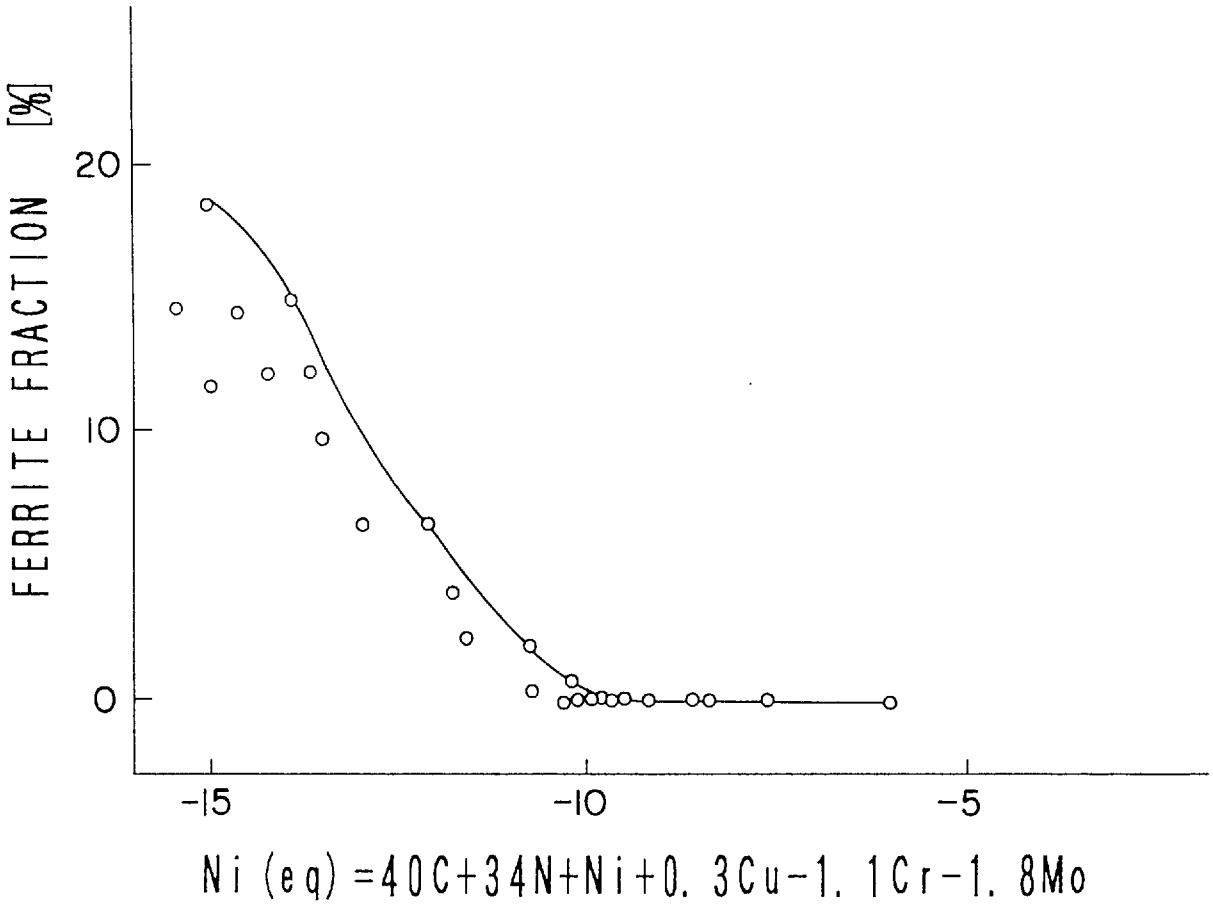
FIG. 3 is a diagram showing the effect of alloying elements on ferrite phase in hot working region.

It is generally known that when a steel is constituted by a single phase of austenite at the rolling temperature, it has good hot workability. In particular, in the case of working which produces large shear deformation, such as seamless rolling, the presence of ferrite even in a small amount causes strain to concentrate in ferrite, resulting in the occurrence of cracking. FIG. 3 is a diagram showing the contribution of each element to the ferrite fraction at 1250° C. It has been found that, in the case of a Ni content of not less than 5%, the formation of ferrite is inhibited when Ni(eq)=40C+34N+Ni+0.3Cu−1.1Cr−1.8Mo is greater than −10.5. When Ni is less than 5%, the minimum Ni(eq) is about −10.0.

Further, 0.02%C−12.6%Cr−1.6%Cu−5.80%Ni steels with the Mo content varied were quenched, tempered, and subjected to a constant load sulfide stress cracking test in environments with varied pH and partial pressure of hydrogen sulfide. The stress was 80% and 90% of the yield strength, and the test time was 720 hr. As is apparent from Table 1, when the Mo content is increased from 1.5% to 2.0%, the sulfide stress cracking resistance, particularly the sulfide stress cracking resistance under a high partial pressure of $H_2S$ can be markedly improved.

TABLE 1

| Environment | Partial pressure of $H_2S$ = 0.010 MPa | | | | Partial pressure of $H_2S$ = 0.020 MPa | | | |
|---|---|---|---|---|---|---|---|---|
| | pH 3.5 | | pH 4.0 | | pH 3.5 | | pH 4.0 | |
| Stress | 80% | 90% | 80% | 90% | 80% | 90% | 80% | 90% |
| 0.1% Mo | F | F | F | F | F | F | F | F |
| 1.0% Mo | NF | F | NF | NF | F | F | F | F |
| 1.5% Mo | NF | NF | NF | NF | F | F | F | F |
| 1.9% Mo | NF | NF | NF | NF | NF | F | NF | NF |
| 2.6% Mo | NF | NF | NF | NF | NF | NF | NF | NF |

F: Cracking occurred
NF: Cracking not occurred

In order to provide satisfactory sulfide stress cracking resistance, it is necessary to add Mo in an amount of not less than about 2.0%. The addition of Mo in such a large amount increases the tendency of ferrite to be formed, resulting in deteriorated hot workability. The addition of Ni in an amount of not less than 5% broadens the range where the requirement for Ni(eq) is satisfied. When the Ni content is low, the above range is narrow and, at the same time, the necessary minimum value of Ni(eq) becomes as large as −10.0.

For the reasons set out above, it was found that when a steel contains not less than 1% of Cu and not less than 13% of Cr+1.6Mo and Ni(eq)≧−10.5 is satisfied in the presence of Mo, the steel is a martensitic steel which can satisfactorily resist the corrosion by $CO_2$ even at a temperature above 150° C. and has excellent sulfide stress cracking resistance and good hot workability.

The function and the reason for the limitation of elements constituting the stainless steel of the present invention will now be described.

C: C is an element which forms a Cr carbide or the resulting in deteriorated corrosion resistance. It, however, has a high capability of forming austenite, offering the effect of inhibiting the formation of a ferrite phase in hot working region. When the amount of C added is less than 0.005%, this effect cannot be attained. On the other hand, when it exceeds 0.05%, carbides such as Cr carbide are precipitated in a large amount, forming a Cr-deplated layer. This deteriorates the resistance to corrosion by $CO_2$ and, at the same time, causes carbides likely to be precipitated in the grain boundaries, resulting in remarkably lowered sulfide stress cracking resistance. For this reason, the C content is limited to 0.005% to 0.05%.

Si: Si contained in the steel is the residual Si after use as a deoxidizer in steelmaking. When the Si content exceeds 0.50%, the toughness and the sulfide stress cracking resistance are deteriorated. Therefore, the Si content is limited to not more than 0.50%.

Mn: Mn is an element which lowers the intergranular strength and deteriorates the cracking resistance in a corrosive environment. It, however, serves to form MnS, rendering S harmless. In addition, it is useful for bringing the structure to a single phase of austenite. When the Mn content is less than 0.1%, this effect cannot be attained. On the other hand, when it exceeds 1.0%, the intergranular strength is significantly lowered, resulting in deteriorated SSC resistance. For this reason, the Mn content is limited to 0.1% to 1.0%.

P: P segregates in the grain boundaries and consequently lowers the intergranular strength, resulting in deteriorated sulfide stress cracking resistance. Therefore, the P content is limited to not more than 0.03%.

S: S forms inclusions based on sulfides, deteriorating the hot workability. Therefore, the upper limit of the S content is 0.005%.

Mo: As with Cr, Mo serves to improve the $CO_2$ corrosion resistance and, in addition, as shown in FIG. 2, has the effect of improving the SSC resistance. When the Mo content is less than 1.0%, the effect is unsatisfactory. Therefore, the amount of Mo added is limited to not less than 1.0%. However, the addition of Mo in an amount of not less than 1.8% is preferred from the viewpoint of providing sufficient sulfide stress cracking resistance. On the other hand, when the amount of Mo added is excessively large, the effect is saturated and, at the same time, the deformation resistance at elevated temperatures on heating is increased, resulting in lowered hot workability. For this reason, the upper limit of the Mo content is 3%.

Cu: Cu is the most important element which is enriched in a corrosion film to improve the resistance to corrosion by $CO_2$ as shown in FIG. 1. A combination of desired corrosion resistance with martensitic structure cannot be attained without Cu. When the Cu content is less than 1.0%, the effect is unsatisfactory. Therefore, the Cu content is limited to not less than 1.0%. On the other hand, when it is excessively high, the hot workability is deteriorated. For this reason, the upper limit of the Cu content is 4%.

Ni: The ability of Cu to improve the corrosion resistance cannot be imparted without the addition of Cu in combination with Ni. This is considered attributable to the fact that Cu combines with Ni to form a compound which is enriched in the corrosion film. The Cu enrichment is difficult in the absence of Ni. Further, Ni has a high capability of forming austenite and, hence, is useful for realizing the martensitic structure and improving the hot workability. When the Ni content is less than 5%, the effect of improving the hot workability is unsatisfactory, while when it exceeds 8%, the $Ac_1$ transformation point becomes excessively low, rendering the tempering difficult.

For the above reason, the Ni content is limited to 5 to 8%.

Al: As in the case of Si, Al contained in the steel is the residual Al after use as a deoxidizer in steelmaking. When the Al content exceeds 0.06%, AlN is formed in a large amount, resulting in deteriorated toughness of the steel. For this reason, the upper limit of the Al content is 0.06%.

Cr and Mo: Cr serves to improve the resistance to corrosion by $CO_2$. As described above, Mo functions likewise. Experiments have revealed that, as shown in FIG. 1, the contribution of Mo to the corrosion rate is 1.6 times the contribution of Cr to the corrosion rate. Therefore, the Cr content is not limited alone but as Cr+1.6Mo. Based on the results shown in FIG. 1, the content of Cr+1.6Mo is limited to not less than 13%.

The steel of the present invention having the above composition has good resistance to corrosion by $CO_2$. However, when ferrite forming elements, such as Cr and Mo, are present in a large amount, a ferrite phase is present at hot working temperatures, resulting in deteriorated hot workability of the steel. In addition, the structure is not constituted by a single phase of martensite even at room temperature, resulting in deteriorated toughness and sulfide stress cracking resistance. For this reason, the contents of ferrite forming elements should be limited.

C, N, Ni, and Cu inhibit the formation of the ferrite phase, whereas Cr and Mo accelerate the formation of the ferrite phase. Steels with the contents of these elements being varied were prepared by the melt process, heated to 1250° C., and cooled with water to observe whether or not ferrite is present, thereby experimentally determining the contribution of individual elements to the formation of a single phase of austenite. As a result, it has been found that, when $Ni(eq)=40C+34N+Ni+0.3Cu-1.8Mo \geqq -10.5$ is satisfied, no ferrite phase is present in the hot working region and the structure is constituted by a single phase of martensite. For the above reason, C, N, Ni, Cu, Cr, and Mo should satisfy the above requirement.

Ca and REM: Ca and REM serve to bring inclusions to a spherical form, thus rendering the inclusions harmless. When the content of Ca and REM is excessively low, the contemplated effect cannot be attained, while when it is excessively high, the amount of inclusions becomes so large that the sulfide stress cracking resistance is deteriorated. Therefore, the Ca content is limited to 0.001 to 0.02% by weight, and the REM content is limited to 0.003 to 0.4% by weight.

Ti and Zr: Ti and Zr combine with P detrimental to the sulfide stress cracking resistance to form a stable compound, thereby reducing the amount of P in a solid solution form to substantially reduce the P content. When the contents of Ti and Zr are low, the contemplated effect cannot be attained. On the other hand, when they are excessively high, coarse oxides are formed to lower the toughness and the sulfide stress cracking resistance. For this reason, the Ti content is limited to 0.005 to 0.1% by weight, and the Zr content is limited to 0.01 to 0.2% by weight.

The steel of the present invention as hot-rolled and after reheating to the $Ac_3$ transformation point or above has a martensitic structure. Since, however, the steel having a martensitic structure is too hard and has low sulfide stress cracking resistance, it should be tempered to form a tempered martensitic structure. When the strength cannot be reduced to a desired level by conventional tempering, the formation of martensite followed by heating to a two-phase region between $Ac_1$ and $Ac_3$ and cooling or additional tempering can provide a tempered martensitic structure having low strength. The martensitic or tempered martensitic composition used herein is classified based on the observation under an optical microscope, and the observation under a transmission electron microscope often reveals the presence of a small amount of austenite.

The present invention will now be described in more detail with reference to the following examples.

At the outset, steels having chemical compositions specified in Table 2 were prepared by the melt process, cast, and rolled by a model seamless rolling mill into seamless steel pipes which were then heat-treated. Steel Nos. 1 to 10 are steels of the present invention, and steel Nos. 11 to 13 are comparative steels. Regarding the comparative steels, Ni(eq) for steel No. 11, Cu for steel No. 12, and Mo for steel No. 13 are outside the scope of the present invention.

The steels were tested for the occurrence of large flaws in the pipe rolling process. The results are also given in Table 2. The occurrence of a flaw was observed for steel No. 11 as the comparative steel, whereas no flaw was found for the other steels.

The steels after various heat treatments were subjected to a mechanical test, a corrosion test, and a stress cracking test. The results are given in Table 3.

TABLE 2

| | Steel No. | Chemical composition (wt %) C | Si | Mn | P | S | Cr | Mo | Cu | Ni | Al | N | Others | Cr+ 1.6 Mo | Ni (eq) | Large flaw in pipe manufacture |
|---|---|---|---|---|---|---|---|---|---|---|---|---|---|---|---|---|
| Steel of inv. | 1 | 0.02 | 0.30 | 0.51 | 0.008 | 0.003 | 12.5 | 1.9 | 1.6 | 5.5 | 0.034 | 0.026 | — | 15.5 | −9.5 | Not occurred |
| | 2 | 0.03 | 0.12 | 0.62 | 0.012 | 0.002 | 11.8 | 2.6 | 1.8 | 7.2 | 0.008 | 0.014 | — | 16.0 | −8.2 | Not occurred |
| | 3 | 0.01 | 0.23 | 0.47 | 0.018 | 0.001 | 12.9 | 1.4 | 1.5 | 6.0 | 0.045 | 0.009 | — | 15.1 | −9.5 | Not occurred |
| | 4 | 0.04 | 0.25 | 0.80 | 0.014 | 0.003 | 12.1 | 1.8 | 2.0 | 5.7 | 0.032 | 0.043 | Ti:0.03 | 15.0 | −7.2 | Not occurred |
| | 5 | 0.02 | 0.09 | 0.32 | 0.006 | 0.004 | 12.2 | 2.0 | 2.9 | 5.2 | 0.052 | 0.016 | — | 15.4 | −9.6 | Not occurred |
| | 6 | 0.02 | 0.12 | 0.50 | 0.022 | 0.001 | 11.5 | 1.9 | 1.7 | 5.7 | 0.032 | 0.013 | Ca:0.008 Zr:0.06 | 14.5 | −8.6 | Not occurred |
| | 7 | 0.03 | 0.18 | 0.49 | 0.015 | 0.002 | 13.1 | 2.1 | 1.9 | 5.7 | 0.035 | 0.017 | REM:0.017 | 16.5 | −10.1 | Not occurred |
| | 8 | 0.04 | 0.11 | 0.85 | 0.011 | 0.002 | 12.4 | 1.9 | 3.6 | 5.4 | 0.048 | 0.018 | — | 15.4 | −8.4 | Not occurred |
| | 9 | 0.01 | 0.41 | 0.28 | 0.019 | 0.002 | 13.0 | 1.5 | 1.4 | 7.5 | 0.033 | 0.009 | — | 15.4 | −8.4 | Not occurred |
| | 10 | 0.02 | 0.35 | 0.51 | 0.024 | 0.002 | 12.3 | 1.3 | 1.8 | 5.6 | 0.027 | 0.013 | Zr:0.04 | 14.4 | −8.5 | Not occurred |
| Comparative steel | 11 | 0.02 | 0.11 | 0.51 | 0.008 | 0.001 | 13.6 | 1.5 | 1.5 | 5.1 | 0.026 | 0.006 | — | 16.0 | −11.1 | Occurred |
| | 12 | 0.02 | 0.23 | 0.69 | 0.007 | 0.002 | 12.7 | 1.4 | — | 5.9 | 0.028 | 0.007 | — | 14.9 | −9.6 | Not occurred |
| | 13 | 0.01 | 0.26 | 0.55 | 0.013 | 0.003 | 15.2 | — | 1.7 | 5.3 | 0.033 | 0.026 | — | 15.2 | −9.6 | Not occurred |

TABLE 3

| | Steel No. | Heat treatment conditions: Reheating conditions | Tempering(1) | Tempering(2) | Corrosion: YS MPa | TS MPa | rate [mm/y] | Sulfide stress cracking |
|---|---|---|---|---|---|---|---|---|
| Steel of inv. | 1 | — | 660° C. × 30 min | — | 734 | 902 | 0.03 | Not occurred |
| | 1 | 870° C. × 30 min air cooling | 660° C. × 30 min | 620° C. × 30 min | 739 | 890 | 0.04 | Not occurred |
| | 1 | 870° C. × 30 min air cooling | 62° C. × 30 min | — | 805 | 930 | 0.03 | Not occurred |
| | 2 | 870° C. × 30 min air cooling | 660° C. × 30 min | — | 741 | 915 | 0.05 | Not occurred |
| | 3 | 870° C. × 30 min air cooling | 620° C. × 30 min | — | 758 | 898 | 0.04 | Not occurred |
| | 4 | 870° C. × 30 min air cooling | 660° C. × 30 min | 620° C. × 30 min | 773 | 904 | 0.04 | N0t occurred |
| | 5 | 870° C. × 30 min air cooling | 660° C. × 30 min | 620° C. × 30 min | 742 | 900 | 0.03 | Not occurred |
| | 6 | 870° C. × 30 min air cooling | 660° C. × 30 min | 620° C. × 30 min | 750 | 888 | 0.06 | Not occurred |
| | 7 | 870° C. × 30 min air cooling | 660° C. × 30 min | 620° C. × 30 min | 766 | 895 | 0.05 | Not occurred |
| | 8 | 870° C. × 30 min air cooling | 660° C. × 30 min | 620° C. × 30 min | 757 | 896 | 0.04 | Not occurred |
| | 9 | — | 660° C. × 30 min | 620° C. × 30 min | 760 | 879 | 0.04 | Not occurred |
| | 10 | — | 660° C. × 30 min | 620° C. × 30 min | 742 | 871 | 0.06 | Not occurred |
| Comparative Steel | 11 | 870° C. × 30 min air cooling | 660° C. × 30 min | 620° C. × 30 min | 765 | 898 | 0.05 | Not occurred |
| | 12 | 870° C. × 30 min air cooling | 66° C. × 30 min | 620° C. × 30 min | 744 | 877 | 0.38 | Not occurred |
| | 13 | 870° C. × 30 min air cooling | 660° C. × 30 min | 620° C. × 30 min | 726 | 874 | 0.04 | Occurred |

The resistance to corrosion by $CO_2$ was determined by immersing a test piece in an artificial sea water of 180° C. equilibrated with $CO_2$ gas of 40 atm and measuring the weight loss by corrosion to determine the corrosion rate.

The sulfide stress cracking resistance was determined by placing an unnotched round rod test piece (diameter in parallel portion 6.4 mm, length in parallel portion 25 mm) into the solution of mixing 1N acetic acid with 1 mol/liter sodium acetate to adjust the solution to pH 3.5, saturated with 10% hydrogen sulfide +90% nitrogen gas, and applying in this state a tensile stress corresponding to 80% of the yield strength to the test piece to measure the breaking time. When the test piece is not broken in a 720-hr test, it can be regarded as having excellent sulfide stress cracking resistance.

As is apparent from Table 3, the corrosion rate of steel No. 12 as the comparative steel was one order of magnitude higher than that of the steels of the present invention. Steel No. 13 caused sulfide stress cracking.

We claim:

1. A martensitic stainless steel having excellent resistance to corrosion by $CO_2$, sulfide stress cracking resistance and good hot workability, capable of developing a tempered martensitic structure, and comprising by weight C: 0.005 to 0.05%, Si≦0.50%, Mn: 0.1 to 1.0%, P≦0.03%, S≦0.005%, Mo: 1.0 to 3.0%, Cu: 1.0 to 4.0%, Ni: 5 to 8%, Al≦0.06%, and at least one element selected from the group consisting of Ti: 0.005 to 0.1%, Zr: 0.01 to 0.2%, Ca: 0.001 to 0.02% and REM: 0.003 to 0.4%, Cr and Mo satisfying a requirement represented by the formula Cr+1.6 Mo≧130; and C, N, Ni, Cu, Cr and Mo satisfying a requirement represented by the formula Ni(eg): 40C+34N+Ni+0.3Cu−1.1Cr−1.8Mo≧−10.5, with the balance consisting essentially of Fe.

2. A martensitic stainless steel having excellent resistance to corrosion by $CO_2$, sulfide stress cracking resistance and good hot workability according to claim 1, wherein said stainless steel comprises at least one element selected from the group consisting of Ti: 0.005 to 0.1% by weight and Zr: 0.01 to 0.2% by weight.

3. A martensitic stainless steel having excellent resistance to corrosion by $CO_2$, sulfide stress cracking resistance and good hot workability according to claim 1, wherein said stainless steel comprises at least one element selected from the group consisting of Ca: 0.001 to 0.02% by weight and REM: 0.003 to 0.4% by weight.

4. A seamless steel gas well pipe comprising the martensitic stainless steel of claim 1, said pipe having excellent resistance to corrosion by $CO_2$, sulfide stress cracking resistance and good hot workability.

* * * * *